US009461402B2

(12) United States Patent
Kim

(10) Patent No.: US 9,461,402 B2
(45) Date of Patent: Oct. 4, 2016

(54) CONNECTION DEVICE FOR PORTABLE TERMINAL

(71) Applicant: Samsung Electronics Co., Ltd., Suwon-si, Gyeonggi-do (KR)

(72) Inventor: Han-Sik Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 120 days.

(21) Appl. No.: 14/057,342

(22) Filed: Oct. 18, 2013

(65) Prior Publication Data

US 2014/0113461 A1 Apr. 24, 2014

(30) Foreign Application Priority Data

Oct. 22, 2012 (KR) ..... 10-2012-0117287

(51) Int. Cl.
*H01R 11/30* (2006.01)
*H01R 13/62* (2006.01)
*H01R 13/64* (2006.01)

(52) U.S. Cl.
CPC ..... *H01R 13/6205* (2013.01); *H01R 13/64* (2013.01)

(58) Field of Classification Search
CPC .. H01R 11/30; H01R 13/6205; H01R 13/64; H01R 13/22; F02P 1/005
USPC ..... 439/39, 38, 40, 129, 289, 633, 677, 680
See application file for complete search history.

(56) References Cited

U.S. PATENT DOCUMENTS

| | | | | |
|---|---|---|---|---|
| 2,573,920 | A * | 11/1951 | McLeod | H01H 36/00 174/53 |
| 7,311,526 | B2 | 12/2007 | Rohrbach et al. | |
| 7,517,222 | B2 | 4/2009 | Rohrbach et al. | |
| 7,658,613 | B1 * | 2/2010 | Griffin | H01R 13/6205 439/39 |
| 7,901,216 | B2 | 3/2011 | Rohrbach et al. | |
| 8,087,939 | B2 | 1/2012 | Rohrbach et al. | |
| 8,177,560 | B2 | 5/2012 | Rohrbach et al. | |
| 8,290,546 | B2 * | 10/2012 | Chen et al. | 455/575.1 |
| 2005/0112951 | A1 * | 5/2005 | Chen et al. | 439/639 |
| 2006/0089027 | A1 * | 4/2006 | Chawgo et al. | 439/133 |
| 2008/0274631 | A1 * | 11/2008 | Lee | H01R 13/6666 439/78 |
| 2011/0104941 | A1 | 5/2011 | Chang et al. | |
| 2011/0281444 | A1 * | 11/2011 | Yasuoka | H01R 13/447 439/39 |

FOREIGN PATENT DOCUMENTS

| | | | |
|---|---|---|---|
| GB | 1232922 | A | 5/1971 |
| KR | 10-0736399 | B1 | 7/2007 |

* cited by examiner

*Primary Examiner* — Neil Abrams
*Assistant Examiner* — Travis Chambers
(74) *Attorney, Agent, or Firm* — Jefferson IP Law, LLP

(57) ABSTRACT

A connection device of a portable terminal is provided. The connection device includes one or more coupling slots provided on a lateral side of the portable terminal, one or more metal pads mounted on a bottom of the one or more coupling slots, and a plug including one or more magnets corresponding to the one or more pads. The one or more magnets are arranged to protrude toward a predetermined side of the plug, and inserted into the one or more coupling slots by an attractive force produced between the one or more metal pads and the one or more magnets, thereby coupling the plug to the lateral side of the portable terminal.

25 Claims, 4 Drawing Sheets

CONNECTION DEVICE FOR PORTABLE TERMINAL

PRIORITY

This application claims the benefit under 35 U.S.C. §119 (a) of a Korean patent application filed on Oct. 22, 2012 in the Korean Intellectual Property Office and assigned Serial No. 10-2012-0117287, the entire disclosure of which is hereby incorporated by reference.

BACKGROUND OF THE INVENTION

1. Field of the Invention

The present invention relates to a portable terminal. More particularly, the present invention relates to a connection device for connecting an external device, for example, a personal computer or a charger, to a portable terminal.

2. Description of the Related Art

A portable terminal denotes a device that allows a user to use a communication function, such as voice communication or short message transmission, a multimedia function, such as reproduction of music or a moving picture, and an entertainment function, such as a game while the user is carrying the portable terminal. Such portable terminals are formed in various shapes in consideration of specialized individual functions and portability thereof. For example, the portable terminals are classified into a bar-type, a folder-type, a sliding-type, or the like according to the external appearances thereof. As the multimedia functions of portable terminals are increasingly emphasized, it has become a trend that the portable terminals are equipped with a large display device. In addition, as the degree of integration of electronic devices is increased, and large capacity and super-high speed communication are popularized, various functions are integrated in a single portable terminal, for example, a mobile communication terminal.

For example, in order to store a large file, for example, a high definition moving picture, to upgrade software or to charge a battery, a portable terminal is connected to an external device, for example, a personal computer or a charger. Recently, portable terminals are configured to be capable of being connected with an external device through a wireless communication method, such as Bluetooth or a Near Field Communication (NFC), and as wireless power transmission technologies have been developed, a wireless charging function is gradually being incorporated in the portable terminals. Wireless communication type connections are currently substantially stabilized, and cloud computing environments are also built which use a storage space provided by a service provider. Accordingly, it has become possible for a user to store a large file in a portable terminal, or to upgrade software of the portable terminal without connecting an external device using a separate cable. However, in general, because wireless power transmission efficiencies are not sufficient yet, portable terminals are physically directly communicated with a charger through a separate cable rather than through a wireless charging method.

For a connection with an external device, a portable terminal is generally provided with an interface terminal. The interface terminal includes a plurality of connection members, for example, a plurality of data pins, and a connector provided on a separate cable is inserted into the interface terminal to connect the portable terminal with the external device. As a connection structure between such an interface terminal and the connector, a plug type insertion structure is generally employed but a structure implemented in a non-insertion contact type is also used. The insertion type connection structure may suffer from infiltration of foreign matter into the inside of the interface terminal formed in a socket shape, and it is not easy for a user to remove the foreign matter. Furthermore, the connection members provided in the plug type connector protrude from the connector body, thereby being exposed to a risk of pollution and damage. Whereas, the non-insertion contact structure enables easy removal of foreign matter even if the foreign matter is adhered to the interface terminal, and the plug side connection members are configured by pogo pins, thereby enabling the exposure thereof to be minimized.

A connection device using such a non-insertion type contact structure is disclosed in Korean Patent No. 10-0736399 registered on Jun. 29, 2007. The disclosed connection device is connected to an external device, such as a portable terminal, through a plane contact between contact terminals, to transmit/receive power and data, in which a magnet is provided so as to strongly retain the connected condition of the contact terminals.

However, the connection device with the non-connection type contact structure of the related-art has a disadvantage in that in the state where the connector is connected to a portable terminal or the like, the connection device may be easily removed from the portable terminal by an external force applied in the direction of the connector. In addition, because the magnet provided in the connector has a substantial magnetic force, a magnetic recording medium, a credit card or the like may be damaged by the magnet. Because the magnet provided in the connector of the related art is exposed to such an extent that the magnet may be directly contacted with other belongings, the magnetic recording medium, the credit card or the like is more likely to be damaged. Moreover, when the magnet is exposed to such an extent that it may be directly contacted with the other belongings, the contact terminals may also be exposed and damaged.

Therefore, a need exists for a connection device for connecting an external device, for example, a personal computer or a charger, to a portable terminal.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above—mentioned problems and/or disadvantages and to provide at least the advantages described below. Accordingly, an aspect of the present invention is to provide a connection device for a portable terminal which has an improved binding force while being configured in a non-connection type contact structure.

Also, another aspect of the present invention is to provide a connection device for a portable terminal which implements a non-insertion type contact structure using a magnet and is capable of suppressing a magnetic recording medium, a credit card or the like from being damaged by the magnetic field of the magnet.

Still another aspect of the present invention is to provide a connection device for a portable terminal which is configured to be capable of preventing connection pins provided on a plug from being contacted with other belongings, thereby suppressing the connection pins from being damaged.

In accordance with another aspect of the present invention, a connection device of a portable terminal is provided. The connection device includes one or more coupling slots provided on a lateral side of the portable terminal, one or more metal pads mounted on a bottom of the one or more coupling slots, and a plug including one or more magnets corresponding to the one or more metal pads. The one or more magnets are arranged to protrude toward a predetermined side of the plug, and inserted into the one or more coupling slots by an attractive force produced between the one or more metal pads and the one or more magnets, thereby coupling the plug to the lateral side of the portable terminal.

In accordance with another aspect of the present invention, a connection device is provided. The connection device includes a plug configured to be connected to a portable terminal The plug includes a concave predetermined side configured to wrap a lateral side of the portable terminal, and one or more magnets arranged to protrude from a bottom of the concave predetermined side of the plug. In addition, the concave predetermined side of the plug becomes in close contact with the portable terminal due to a magnetic force of the one or more magnets, and both side edges of the concave predetermined side of the plug extends farther than ends of the magnets from the bottom to wrap the lateral side of the portable terminal.

In accordance with another aspect of the present invention, a connection device of a portable terminal is provided. The connection device includes a plurality of connection pads arranged on a lateral side of the portable terminal, and one or more coupling slots arranged adjacent to the plurality of connection pads on the lateral side of the portable terminal. Each of the one or more coupling slots has a shape that is asymmetrical in vertical and horizontal directions.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
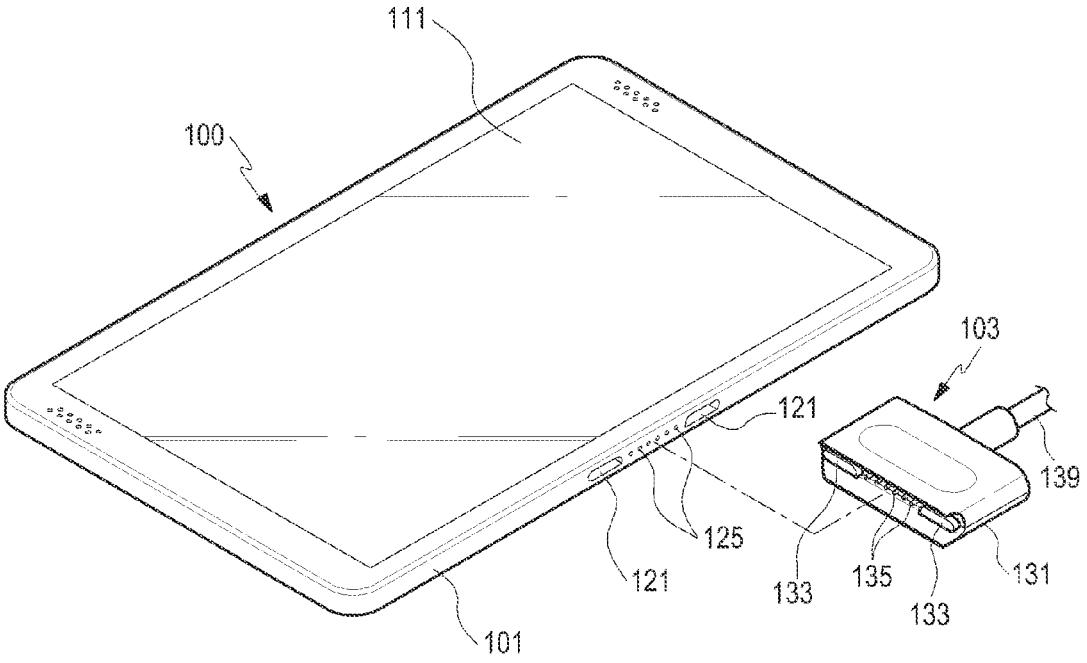
FIG. 1 is a perspective view illustrating a connection device that is prepared to be connected with a portable terminal according to an exemplary embodiment of the present invention.
Figure 2:
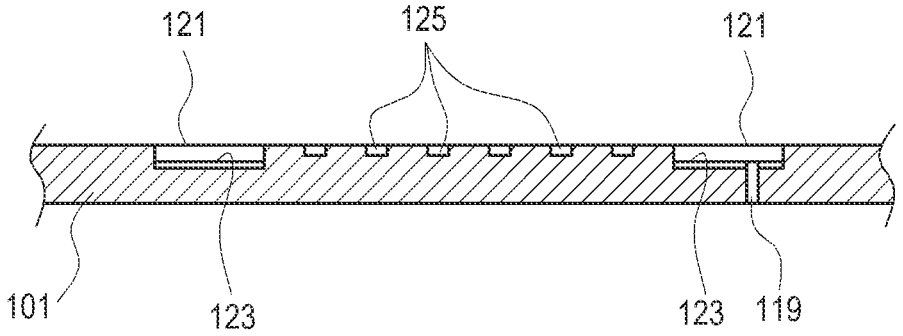
FIG. 2 is a cross-sectional view illustrating an interface terminal mounted in a portable terminal in the connection device depicted in FIG. 1 according to an exemplary embodiment of the present invention.
Figure 3:
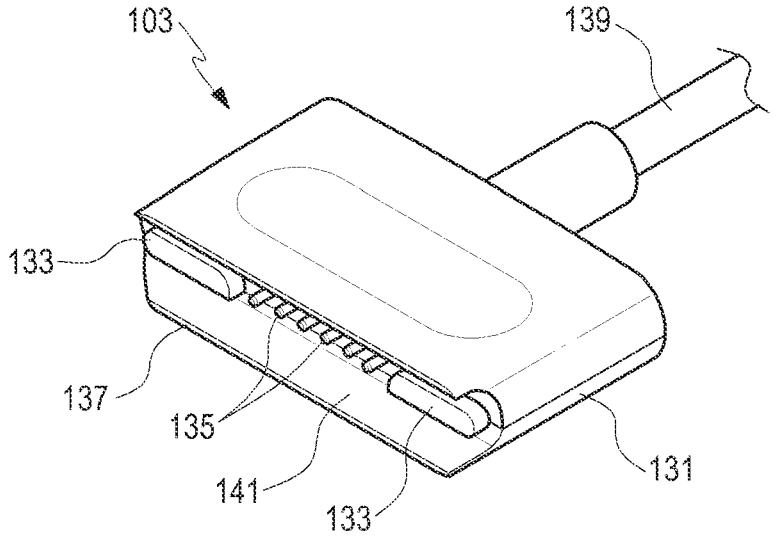
FIG. 3 is a perspective view illustrating a plug of the connection device depicted in FIG. 1 according to an exemplary embodiment of the present invention.
Figure 4:
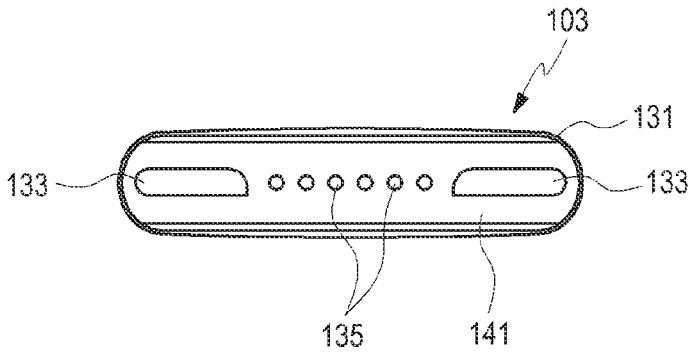
FIG. 4 is a front view illustrating the plug depicted in FIG. 3 according to an exemplary embodiment of the present invention.
Figure 5:
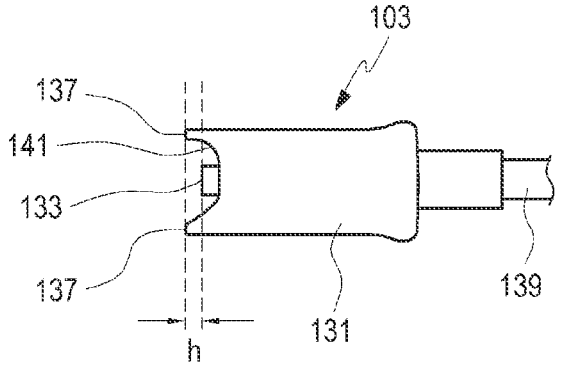
FIG. 5 is a side view illustrating the plug depicted in FIG. 3 according to an exemplary embodiment of the present invention.
Figure 6:
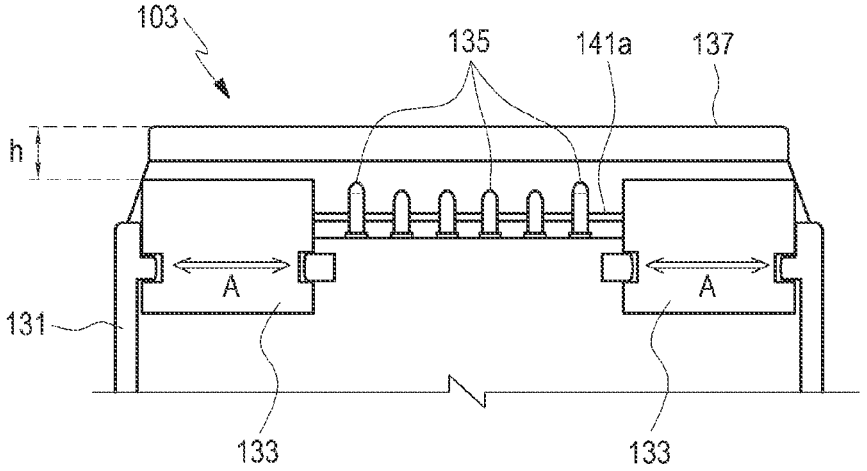
FIG. 6 is a top plan view illustrating the internal configuration of the plug depicted in FIG. 3 in which a part of the plug is removed according to an exemplary embodiment of the present invention.
Figure 7:
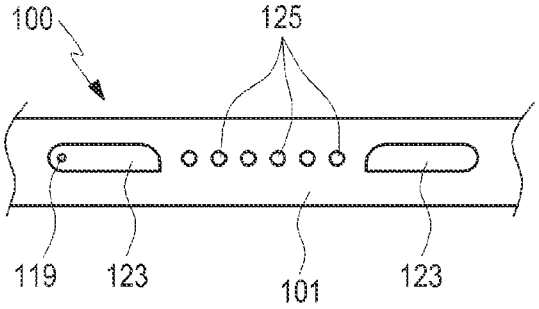
FIG. 7 is a front view illustrating an interface terminal mounted in the portable terminal in the connection device depicted in FIG. 1 according to an exemplary embodiment of the present invention.
Figure 8:
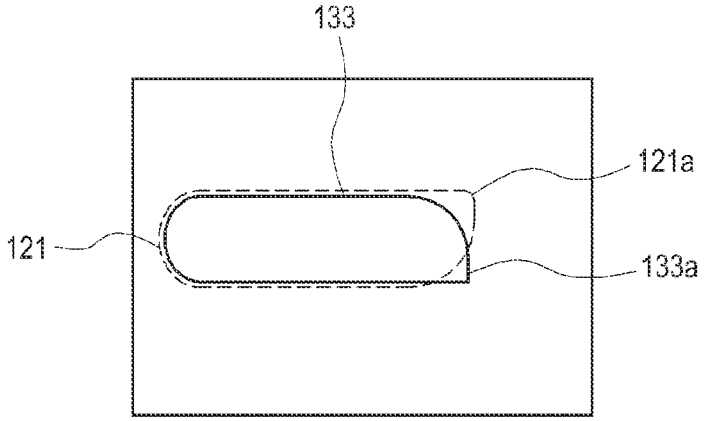
FIG. 8 is a schematic view for describing shapes of a magnet and a coupling slot of the connection device depicted in FIG. 1 according to an exemplary embodiment of the present invention.
Figure 9:
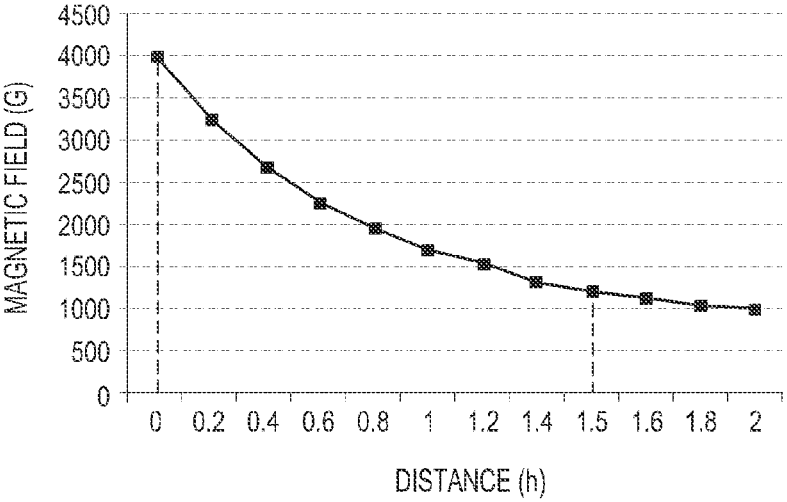
FIG. 9 is a graph for describing a distribution of a magnetic field according to a distance from a magnet of the connection device depicted in FIG. 1 according to an exemplary embodiment of the present invention.

FIG. 1 is a perspective view illustrating a connection device that is prepared to be connected with a portable terminal according to an exemplary embodiment of the present invention. FIG. 2 is a cross-sectional view illustrating an interface terminal mounted in a portable terminal in the connection device depicted in FIG. 1 according to an exemplary embodiment of the present invention. FIG. 3 is a perspective view illustrating a plug of the connection device depicted in FIG. 1 according to an exemplary embodiment of the present invention. FIG. 4 is a front view illustrating the plug depicted in FIG. 3 according to an exemplary embodiment of the present invention. FIG. 5 is a side view illustrating the plug depicted in FIG. 3 according to an exemplary embodiment of the present invention. FIG. 6 is a top plan view illustrating the internal configuration of the plug depicted in FIG. 3 in which a part of the plug is removed according to an exemplary embodiment of the present invention. FIG. 7 is a front view illustrating an interface terminal mounted in the portable terminal in the connection device depicted in FIG. 1 according to an exemplary embodiment of the present invention. FIG. 8 is a schematic view for describing shapes of a magnet and a coupling slot of the connection device depicted in FIG. 1 according to an exemplary embodiment of the present invention. FIG. 8 is a schematic view for describing shapes of a magnet and a coupling slot of the connection device depicted in FIG. 1 according to an exemplary embodiment of the present invention. FIG. 9 is a graph for describing a distribution of a magnetic field according to a distance from a magnet of the connection device depicted in FIG. 1 according to an exemplary embodiment of the present invention.

Referring to FIGS. 1-9, a connection terminal of a portable terminal 100 according to an exemplary embodiment of the present invention includes a coupling slot 121 provided on a lateral side of the portable terminal 100, a metal pad 123 provided in the coupling slot 121, and a plug 103 provided with a magnet 133, in which a cable 139 extending from the plug 103 is connected with an external device, such as a personal computer or a charger, thereby connecting the portable terminal 100 to the external device. In that event, the plug 103 is coupled in such a manner that a predetermined side 141, more specifically, a surface coupled to be in contact with the lateral side of the portable terminal 100, wraps a part of the lateral side of the portable terminal 100. In the state in which the plug 103 is coupled to the lateral side of the portable terminal 100, the magnet 133 is inserted into the coupling slot 121, and the plug 103 may be retained in the coupled state with the portable terminal 100 by the magnetic force produced between the magnet 133 and the metal pad 123, i.e., an attractive force produced as the magnetic force of the magnet 133 acts on the metal pad 123.

Although FIG. 1 exemplifies a tablet Personal Computer (PC) as the portable terminal 100, one ordinarily skilled in the art will easily understand that the connection device according to an exemplary embodiment of the present invention is applicable to any type of a portable terminal, for example, a portable multimedia reproducing device, a mobile phone, an electronic scheduler, an electronic dictionary, a laptop computer, or the like if the portable terminal includes a removable power cable or a connection cable.

The portable terminal 100 includes a display device 111 installed on the front side of the portable terminal 100, in which the display device 111 uses a great part of the area of the front side of the portable terminal 100 as a screen display region. The display device 111 may be provided with a sound output device on one lateral side or both lateral sides thereof, in which the sound output device may output sounds to the front side of the portable terminal 100. On a lateral side of the portable terminal 100, connection pads 125 as well as the coupling slot 121 are arranged, and although not depicted, a power key, a volume control key, a memory card slot or the like may be arranged. The portable terminal 100 may be completed by forming the coupling slot 121, the connection pads 125, various keys, slots, etc. in a housing 101, of which the front side is opened, and assembling the display device 111 to the opened front side of the housing 101.

Referring FIGS. 2 and 7 in particular, the coupling slot 121 is formed on the lateral side of the portable terminal 100. More specifically, the coupling slot 121 is recessed from the surface of the lateral side of the housing 101 by a predetermined depth, and the metal pad 123 is arranged on the bottom of the coupling slot 121. The metal pad 123 is embedded in a synthetic resin or metal that forms the housing 101 at a part, preferably at an edge area thereof in order to prevent the metal pad 123 from breaking away from the coupling slot 121 by the magnetic force of the magnet 133. Because the plug 103 is coupled to the portable terminal 100 by the attractive force produced between the metal pad 123 and the magnet 133, the metal pad 123 should be fabricated from a metal, such as stainless steel, that is magnetizable when it is positioned within a magnetic field.

The connection pads 125 are arranged on the lateral side of the portable terminal 100. If they merely constitute an interface terminal for charging, only one pair of the connection pads 125 may be arranged. However, the number of connection pads 125 may be variously set according to the design of the portable terminal or the interface terminal to be configured. For example, in the specific exemplary embodiments of the present invention, six connection pads 125 may be arranged. In arranging the connection pads 125 on the lateral side of the portable terminal 100, it is preferable that the connection pads 125 are arranged in one row along the lengthwise or widthwise direction of the portable terminal 100. This is to prevent the thickness of the portable terminal 100 from being increased due to the arrangement of the connection pads 125. Of course, if the thickness of the portable terminal 100 is sufficient regardless of the connection pads 125, the connection pads 125 may be arranged in two or more rows.

Preferably, a pair of coupling slots 121 is arranged at the opposite ends of the arrangement of the connection pads 125, respectively, and may be arranged symmetrical to each other with respect to the connection pads 125 there between. That is, the connection pads 125 are arranged between the pair of coupling slots 121. By arranging the coupling slots 121 at the opposite ends of the arrangement of the connection pads 125, respectively, each of the connection pads 125 is allowed to be stably contacted with the connection pins 135 provided in the plug 103.

Although the specific exemplary embodiment exemplifies a construction in which the coupling slots 121 are arranged at the opposite ends of the arrangement of the connection pads 125, respectively, one or more coupling slots 121 may be added according to the number of the connection pads 125. For example, when six connection pads 125 are arranged, three connection pads 125 may be arranged in one row at each side of one coupling slot 121 and other coupling slots 121 may be arranged at the opposite side of the arrangement of the connection pads 125 and the one coupling slot 121, respectively. Additionally arranging one or more coupling slots 121 between the connection pads 125 will be useful when the number of the connection pads 125 is increased. In addition, when three coupling slots 121 are formed and one metal pad 123 is arranged in each of the coupling slots 121, it is possible to provide a sufficient magnetic force while reducing the magnetic force of each magnet 133 for coupling the plug 103 to the portable terminal 100. In this manner, the number of the connection pads 125, and the number of the coupling slots 121 may be variously set in consideration of the design of the final product and a use of an interface terminal to be configured.

Meanwhile, the portable terminal 100 may include a sound input hole 119 (see FIGS. 2 and 7). Sound input is executed through a microphone installed in the housing 101, and sounds are transmitted from the outside to the microphone installed in the housing 101 through the sound input hole 119. In such a case, the sound input hole 119 may be arranged on any of the coupling slots 121. In a case in which the sound input hole 119 is arranged on any of the coupling slots 121, the sound input hole 119 is formed through the corresponding metal pad 123.

Herein below, the configuration of the plug 103 in the portable terminal 100 will be described in more detail with respect to FIGS. 3 to 6.

The plug 103 is provided with the magnets 133 on a predetermined side 141 thereof, and connected to an end of the cable 139. The predetermined side 141 of the plug 103, in which the magnets 133 are arranged, may be formed in a concave shape that wraps a part of the lateral side of the portable terminal 100. Accordingly, as illustrated in FIG. 5, the concave predetermined side 141 of the plug 103 may be rounded to correspond to the shape of the lateral side of the portable terminal 100. The magnets 133 will provide a force to couple the plug 103, more specifically the body 131 of the plug 103 to the portable terminal 100. That is, as described above, the magnets 133 produce an attractive force in relation to the metal pads 123 arranged in the coupling slots 121, thereby attaching and coupling the plug 103 to the portable terminal 100.

The magnets 133 protrude toward an end 137 of the plug 103 from the bottom 141*a* of the concave predetermined side 141 of the plug 103, and the end of each of the magnets 133 is positioned between the bottom 141*a* and the end 137 of the plug 103. The protrusion length of the magnets 133 from the bottom 141*a* is preferably equal to or less than the depth of the coupling slots 121, i.e., the distance from the surfaces of the metal pads 123 to the outer peripheral surface of the portable terminal 100, more specifically to the outer peripheral surface of the housing 101. It is not preferable that the protrusion length of the magnets 133 is larger than the depth of the coupling slots 121, because in this case the predetermined side 141 of the plug 103 cannot be closely contacted with the lateral side of the portable terminal 100. However, even if the protrusion length of the magnets 133 is smaller than the depth of the coupling slots 121, the attractive force between the magnets 133 and the metal pads 123 enables the predetermined side 141 of the plug 103 to be closely contacted with the lateral side of the portable terminal 100. That is, even if not directly contacted with the metal pads 123, the magnets 133 will enable the predetermined side 141 of the plug 103 to be closely contacted with the lateral side of the portable terminal 100.

Meanwhile, it is preferable that the ends of the magnets 133 are positioned between the end 137 of the plug 103 and the bottom 141*a* in the protrusion direction of the magnets 133. The height difference h between the ends of the magnets 133 and the end 137 of the plug 103 from the bottom 141*a* may be set to be not less than 1.5 mm and not more than 2.0 mm. If the end 137 of the plug 103 is formed to protrude farther than the ends of the magnets 133, it is possible to increase the binding force between the plug 103 and the portable terminal 100 while suppressing a magnetic recording medium, a credit card or the like from being damaged by the magnetic force of the magnets 133.

The magnetic force is gradually reduced as the distance from the magnets 133 is increased. Referring to FIG. 9, the magnetic force of a magnet of 4,000 G is reduced to 1,200 G at a distance of 1.5 mm from the magnet. If the end 137 of the plug 103 is positioned farther than the ends of the magnets 133 from the bottom 141*a*, it is possible to prevent a main part of a user's belonging, for example, a magnetic recording medium or a credit card from being directly contacted with the magnets 133, and even if the end 137 of the plug 103 approaches the user's belonging, the user's belonging can be maintained at a distance not less than 1.5 mm from the magnets 133. Although the height difference h between the ends of the magnets 133 and the end 137 of the plug 103 from the bottom 141*a* is specifically presented in this specific exemplary embodiment, it is apparent that the height difference h may be variously set according to the portable terminal 100 where the inventive connection device is applied. For example, because a cellular phone, a tablet PC and a laptop computer have different sizes and mounting spaces, the size or intensity of the magnetic field of the magnets 133, and the extension length of the end 137 of the plug 103 may be properly changed according to the types of such portable terminals.

In addition, by increasing the extension of the end 137 of the plug 103 from the bottom 141*a*, it is possible to increase the binding force between the plug 103 and the portable terminal 100. In the state where the plug 103 is coupled to the portable terminal 100, the plug 103 may be easily removed from the portable terminal 100 by a force applied in the thickness direction, more specifically in the vertical direction in the state depicted in FIG. 5. In such a case, when the predetermined side 141 of the plug 103 was formed concavely and the heights of the ends of the magnets 133 and the end 137 of the plug 130 were designed to be equal to each other or to have a difference of not more than 0.5 mm in configuring the inventive connection device in a specific portable terminal 100 model, the plug 103 was removed from the portable terminal 100 by a force of about 0.4 kgf. Whereas, when the height distance h between the ends of the magnets 133 and the end 137 of the plug 103 is designed to be 1.5 mm, the plug 103 coupled to the portable terminal 100 was removed only when a force of not less than 0.8 kgf is applied. Although the binding force according to the height distance h is varied according to the types of terminals to which the inventive connection device is applied, the binding force between the plug 103 and the portable terminal 100 is generally increased in proportion to the height difference h.

As described above, the height difference between the ends of the magnets 133 and the end 137 of the plug 103 not only prevents the user's belongings, such as a magnetic recording medium or a credit card, from being damaged by the magnetic force of the magnets 133, but also increases the binding force between the plug 103 and the portable terminal 100.

Meanwhile, it is preferable that the end face of each of the magnets 133 is formed in an asymmetrical shape to correspond to the shape of the coupling slots 121. More particularly, referring to FIGS. 4 and 7, it can be appreciated that the end face of each of the magnets 133 and each of the coupling slots 121 are asymmetrically formed in vertical and horizontal directions. In FIGS. 4 and 7, the end face of each of the magnets 133 extends in the horizontal direction, and one end of the face of each of the magnets 133 has a semi-circular shape, and the other end has a fan shape of an angle of 90 degrees. The shapes of the magnets 133 and the coupling slots 121 as described above limit the coupling direction of the plug 103 to the terminal 100. When the plug 103 is coupled to the portable terminal 100 in a direction different from the designed direction, the magnets 133 cannot be introduced into the coupling slots 121, and an electric connection between the plug 103 and the portable terminal 100 cannot be established. One end of the end face of each magnet 133 and one end of each coupling slots 121 has a fan shape of an angle of 90 degrees. Therefore, when the plug 103 is coupled to the portable terminal 100 in a direction different from the designed direction, an angled corner part 133*a* of the magnet 133 is interfered with the outer peripheral surface of the portable terminal 100 rather than being inserted into an angled corner part 121*a* of the coupling slot 121. As a result, as the end face of the magnet 133 and the coupling slot 121 are made to correspond with each other in an asymmetrical shape, a direction for coupling the plug 103 to the portable terminal 100 can be set. Setting the coupling direction in this manner is to allow the plug 103 to be coupled to the portable terminal 100 according to the arrangements of the connection pads 125 and the connection pins 135. This will be described in more detail below.

Meanwhile, in the state depicted in FIG. 4, the magnets 133 may be arranged on the predetermined side 141 of the plug 103 to be movable individually in vertical and horizontal directions. In FIG. 6, arrow A indicates the horizontal direction where each of the magnets 133 is moved on the predetermined side 141 of the plug 103. This is to allow the magnets 133 to be easily introduced into the coupling slots 121 by the attractive force between the magnets 133 and the metal pads 123 even when the coupling positions are somewhat deviated from each other when coupling the plug 103 to correspond to the connection pads 125. It is preferable that the movable range of each of the magnets 133 on the predetermined side 141 of the plug 103 is set to about 0.05 mm. If the movable range of the magnets 133 is too small, it is not practically different from the case where the magnets 133 are fixed to the body 131 of the plug 103. If the movable range of the magnets 133 is too large, the connection pins 135 may not be correctly connected with the corresponding connection pads 125, respectively, in the state where the plug 103 are attached and fixed to the portable terminal 100. That is, even if the magnets 133 are inserted into and fixed to the coupling slots 121, the plug body 131 may be moved on the portable terminal 100 or fixed to the portable terminal 100 in the state in which the connection pads 125 and the connection pins 135 are deviated from each other.

Referring to FIG. 6, the connection pins 135 are made up of pogo pins, respectively, and are arranged on the predetermined side 141 of the plug 103, more specifically on the bottom 141*a* to correspond to the number of the connection pads 125. The magnets 133 are arranged at the opposite ends of the arrangement of the connection pins 135, respectively, and are symmetrical to each other with respect to the connection pins 135 there between. That is, the plug 103 is provided with a pair of magnets 133, which may be arranged with the same polarity. As such, because the magnets 133 and the metal pads 123 are arranged at the opposite ends of the arrangement of the connection pins 135 and the connection pads 125, respectively, and produces an attractive force, each of the connection pins 135 receives a uniform force when the connection pins 135 are connected with the connection pads 125 so that the connected condition there between can be stably maintained. When the plug 103 is coupled to the portable terminal 100 by the attractive force between the magnets 133 and the metal pads 123, the connection pins 135 are contacted with the corresponding connection pads 125, respectively.

The connection pins 135 are configured to transmit various signals, and may include a power pin and a ground pin. That is, the connection device according to the exemplary embodiment of the present invention may be used for supplying power of the portable terminal 100, for supplying charging power for the portable terminal 100, etc. In the connection pins 135, one pair of power pins and one pair of ground pins may be provided. This is to assure a stable supply of power in the state where the plug 103 is coupled to the portable terminal 100. In addition, the connection pins 135 may include signal pins for transmitting various data beyond the power pins and the ground pins.

In the case where the connection pins 135 include the power pins, the ground pins and the signal pins, the signal pins are preferably arranged between the power pins and the ground pins. By arranging the signal pins between the power pins and the ground pins, it is possible to secure a distance between the power pins and the ground pins to be as large as possible. This is to prevent the power pins and the ground pins from being damaged by an external force or polluted by foreign matter because the damage and the pollution may cause circuit short. The signal pins among the connection pins 135 may be used as audio signal terminals or the like. That is, the portable terminal 100 may be connected to a sound device, such as a speaker device through the plug 103. In such a case, the plug 103 may be used as a dock connector for a sound device without being connected to the cable 139 of the plug 103.

The present exemplary embodiment of the present invention exemplifies a construction in which six pins are arranged in the order of ground pin 1-signal pin 1 -power pin 1-power pin 2-signal pin 2-ground pin 2. If the signal pins are arranged between the ground pins and the power pins as described above, in which for example, the signal pin 1 and the signal pin 2 are configured to transmit signals which are different from each other, the direction for coupling the plug 103 to the portable terminal 100 is limited to one single direction. Accordingly, as described above, the direction for coupling the plug 103 to the portable terminal 100 is set by forming the end face of each magnet 133 and each coupling slot 121 in an asymmetrical shape.

Meanwhile, referring to FIG. 6, it is preferable that in arranging the connection pins 135 in the plug 103, the pair of ground pins is arranged at the edges thereof to protrude farther than the power pins or signal pins from the bottom 141*a*. This allows the ground pins of the portable terminal 100 and the ground pins of the plug 103 to be connected first when the plug 103 is coupled to the portable terminal 100, thereby preventing the occurrence of a spark when the other connection pins are contacted with the corresponding connection pads 125. In addition, in the protrusion direction of the magnets 133, the ends of the connection pins 135 may be positioned between the ends of the magnets 133 and the bottom 141*a*. As such, the connection pins 135 are surrounded and protected by the concave predetermined side 141 of the plug 103 and the magnets 133.

If the arrangement of the connection pads 125 and the arrangement of the connection pins 135 are out of mesh in the process of coupling the plug 103 as described above to the portable terminal 100, the magnets 133 are interfered with the housing 101 of the portable terminal 100 such that the plug 103 cannot be coupled to the portable terminal 100. That is, the user is always allowed to couple the plug 103 to the portable terminal 100 only in the predetermined direction. As the side edges of the predetermined side 141 of the plug 103 extends farther than the ends of the magnets 133 to wrap the portable terminal 100 in the state in which the plug 103 is coupled to the portable terminal 100, a sufficient binding force can be provided between the plug 103 and the portable terminal 100. In addition, because the contact between the magnets 133 and an external object are prevented by the extending end of the plug 103, it is possible to suppress a magnetic recording medium, a credit card or the like from being damaged by the magnets 133 provided in the plug 103.

As described above, because the connection device of a portable terminal is configured such that the plug connected to a cable is coupled to the portable terminal to wrap a lateral side of the portable terminal, the binding force between the plug and the portable terminal can be increased such that the connected condition between the plug and the portable terminal can be stably maintained. In addition, because the predetermined side of the plug configured to wrap the portable terminal is formed concavely, and the magnets and the connection pins are arranged in the state where they are accommodated in the concave portion of the plug, it is possible to prevent the magnets and the connection pins from being directly contacted with the user's belongings. Accordingly, the connection pins provided in the plug as well as the magnetic recording medium and the credit card can be prevented from being damaged even if the magnetic recording medium and the credit card are carried together with the inventive connection device.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A connection device of a portable terminal, the connection device comprising:

one or more coupling slots provided on a lateral side of the portable terminal;

one or more metal pads mounted on a bottom of the one or more coupling slots; and a plug including magnets corresponding to the one or more metal pads and a plurality of connection pins between the magnets at a predetermined side, wherein the magnets are arranged to protrude away from the predetermined side of the plug, and inserted into the one or more coupling slots by an attractive force produced between the one or more metal pads and the magnets, thereby coupling the plug to the lateral side of the portable terminal, wherein the connection pins protrude between ends of the magnets and the predetermined side, wherein the connection pins include at least one power pin and at least one ground pin and an end of the ground pin is positioned between the ends of the magnets and an end of the power pin, and wherein an end face of each of the magnets has an asymmetrical shape.

2. The connection device of claim 1, further comprising:

a sound input hole formed through any of the one or more metal pads.

3. The connection device of claim 1, wherein at least one pair of the magnets are arranged on the plug and the magnets have the same polarity.

4. The connection device of claim 1, wherein the magnets are movable in vertical and horizontal directions on the predetermined side of the plug.

5. The connection device of claim 1, further comprising:

a plurality of connection pads arranged on the lateral side of the portable terminal, wherein the connection pins are arranged on the predetermined side of the plug, and wherein as the plug is coupled to the portable terminal, each of the connection pins is connected with one of the plurality of connection pads.

6. The connection device of claim 5, wherein the one or more coupling slots are provided at opposite sides of the arrangement of the plurality of connection pads, and the magnets are provided at opposite sides of the arrangement of the connection pins.

7. The connection device of claim 5, wherein the magnets are arranged at the opposite sides of the arrangement of the connection pins to be symmetrical to each other with respect to the arrangement of the connection pins.

8. The connection device of claim 5, wherein the connection pins includes a pair of power pins and a pair of ground pins.

9. The connection device of claim 8, wherein the connection pins further include a pair of signal pins, which are arranged between the power pins and the ground pins.

10. A connection device comprising:

a plug configured to be connected to a portable terminal, wherein the plug comprises a concave predetermined side configured to wrap a lateral side of the portable terminal, and one or more magnets arranged to protrude from a bottom of the concave predetermined side of the plug, wherein the concave predetermined side of the plug becomes in close contact with the portable terminal due to a magnetic force of the one or more magnets, and both side edges of the concave predetermined side of the plug extends farther than ends of the one or more magnets from the bottom to wrap the lateral side of the portable terminal, and wherein an end face of at least one of the magnets has an asymmetrical shape.

11. The connection device of claim 10, further comprising:

one or more coupling slots formed on the lateral side of the portable terminal, the one or more magnets being inserted into the one or more coupling slots, wherein the end face of each of the one or more magnets comprises a shape that is asymmetric in vertical and horizontal directions, and each of the one or more coupling slots has a shape corresponding to the end face of each of the one or more magnets.

12. The connection device of claim 10, further comprising:

one or more metal pads mounted on the lateral side of the portable terminal, wherein the magnetic force of the one or more magnets acts on the one or more metal pads to produce an attractive force, thereby causing the concave predetermined side of the plug to be closely contacted with the lateral side of the portable terminal.

13. The connection device of claim 10, wherein each of the one or more magnets is movable in vertical and horizontal directions on the concave predetermined side of the plug.

14. The connection device of claim 10, further comprising:

a plurality of connection pins arranged on the concave predetermined side of the plug, wherein the one or more magnets are arranged at opposite sides of the arrangement of the plurality of connection pins, respectively.

15. The connection device of claim 14, wherein the plurality of connection pins includes a pair of power pins and a pair of ground pins.

16. The connection device of claim 10, wherein the one or more magnets protrude toward the side edges of the concave predetermined side of the plug from the bottom of the concave predetermined side of the plug.

17. The connection device of claim 16, wherein in a protruding direction of the one or more magnets from the bottom of the concave predetermined side of the plug, the ends of the one or more magnets are positioned between the bottom of the concave predetermined side of the plug and the side edges of the concave predetermined side of the plug.

18. A connection device of a portable terminal, the connection device comprising:

a plurality of connection pads arranged on a lateral side of the portable terminal; and one or more coupling slots arranged adjacent to the plurality of connection pads on the lateral side of the portable terminal, wherein each of the one or more coupling slots has a shape that is asymmetrical in vertical and horizontal directions.

19. The connection device of claim 18, further comprising the one or more metal pads installed in the one or more coupling slots, respectively.

20. The connection device of claim 18, wherein the one or more coupling slots are arranged at opposite sides of the arrangement of the plurality of connection pads.

21. The connection device of claim 20, wherein the one or more coupling slots are arranged symmetrical to each other with respect to the plurality of connection pads there between.

22. The connection device of claim 18, further comprising a sound input hole positioned on any of the one or more coupling slots.

23. The connection device of claim 22, further comprising one or more metal pads installed in the one or more coupling slots, respectively, wherein the sound input hole is formed through any of the one or more metal pads.

24. A connection device of a portable terminal, the connection device comprising:

a plurality of connection pads arranged on a lateral side of the portable terminal;

a pair of coupling slots arranged adjacent to both end of an arrangement of connection pads on the lateral side of the portable terminal;

a pair of metal pads installed in the one or more coupling slots, respectively; and a sound input hole positioned on any of the coupling slots, wherein each of the one or more coupling slots has a shape that is asymmetrical in vertical and horizontal directions.

25. The connection device of claim 24, wherein the one or more coupling slots are arranged symmetrical to each other with respect to the plurality of connection pads there between.

* * * * *